US007146830B2

(12) United States Patent
Huang

(10) Patent No.: US 7,146,830 B2
(45) Date of Patent: Dec. 12, 2006

(54) ERROR-PROOFING COMBINATION PADLOCK

(76) Inventor: Chien-Yung Huang, 5E-10, No. 5, Sec. 5, Shin-Yi Rd., Taipei (TW)

( * ) Notice: Subject to any disclaimer, the term of this patent is extended or adjusted under 35 U.S.C. 154(b) by 230 days.

(21) Appl. No.: 10/979,132

(22) Filed: Nov. 3, 2004

(65) Prior Publication Data

US 2006/0090526 A1 May 4, 2006

(51) Int. Cl.
*E05B 37/06* (2006.01)

(52) U.S. Cl. ..... 70/25; 70/312; 70/315; 70/323; 70/326; 70/22

(58) Field of Classification Search ..... 70/21, 70/22, 25–30, 233, 312, 315–318, 323–326, 70/329, 332
See application file for complete search history.

(56) References Cited

U.S. PATENT DOCUMENTS 4,444,029 A * 4/1984 Remington ..... 70/25
4,733,548 A * 3/1988 Ling ..... 70/25
5,125,248 A * 6/1992 Ling ..... 70/25
5,520,032 A * 5/1996 Ling ..... 70/25
5,746,075 A * 5/1998 Yang ..... 70/25
6,904,776 B1 * 6/2005 Lin ..... 70/25
7,007,521 B1 * 3/2006 Misner et al. ..... 70/21
2005/0034492 A1 * 2/2005 Yu ..... 70/25
2005/0092036 A1 * 5/2005 Lai ..... 70/25

* cited by examiner

*Primary Examiner*—Suzanne Dino Barrett
(74) *Attorney, Agent, or Firm*—Bacon & Thomas, PLLC

(57) ABSTRACT

An error-proofing combination padlock has a casing assembly, multiple dials, multiple sleeves, a shackle, a locking bolt and a spring. The dials are mounted rotatably inside the casing assembly. The sleeves are mounted rotatably and respectively inside the dials. The shackle is mounted retractably and pivotally on the casing assembly. A locking bolt is mounted slidably through the sleeves. The error-proofing combination padlock prevents dials from rotating except when the shackle is located in the locking (first) position or the combination-resetting (third) position and avoids a new and unintended unlocking combination arising during a resetting operation of the combination.

4 Claims, 9 Drawing Sheets

ERROR-PROOFING COMBINATION PADLOCK

BACKGROUND OF THE INVENTION

1. Field of the Invention

The present invention relates to a padlock, and more particularly to an error-proofing combination padlock that prevents an error when resetting an unlocking combination.

2. Description of Related Art

A combination padlock can be opened without any keys and has an unlocking combination that can be reset at will to prevent the combination from being obtained after trial and error by any unauthorized person.

A conventional combination padlock has a casing, a shackle and multiple dials. The shackle is mounted retractably and pivotally on the casing. The dials are mounted rotatably through the casing. According to different positions of the shackle relative to the casing, a user can implement the locking in a first position, unlocking in a second position and the reset of the unlocking combination in a third position.

However, the conventional combination padlock has disadvantages described as follow:

1. No matter which one of these three positions the shackle relative to the casing is in, the dials are always rotatable. If any one of the dials is accidentally rotated while the shackle is in the unlocking position, the shackle will be located at this second position and can't move to the first or second position until the rotating back of that dial. Therefore, the operation of the padlock is troublesome and often causes some mistakes.

2. To reset the unlocking combination, the shackle must be pivoted to the resetting position and depressed slightly into the casing to compress a spring inside the casing. A new unlocking combination is acquired by rotating the dials and then releasing the depressed shackle. However, a user often inadvertently releases the depressed shackle halfway during the resetting operation and unconsciously continues the rotation of some of the dials to leave some of dials rotated to unpredicted combination numbers and the others remaining at the desired combination numbers. After the flawed resetting operation, the user cannot open the locked padlock anymore.

To overcome the shortcomings, the present invention provides an error-proofing combination padlock to mitigate or obviate the aforementioned problems.

SUMMARY OF THE INVENTION

The main objective of the invention is to provide an error-proofing combination padlock that prevents dials from rotating except when the error-proofing combination padlock's shackle is in a first and second position is locked and avoids a new unlock combination with some undesired combination numbers being set during resetting operation of the unlock combination.

The error-proofing combination padlock in accordance with the present invention comprises a casing assembly, multiple dials, multiple sleeves, a shackle, a locking bolt and a spring.

The dials are mounted rotatably inside the casing assembly. The sleeves are mounted rotatably and respectively inside the dials. The shackle is mounted retractably and pivotally on the casing assembly. The locking bolt is mounted slidably through the sleeves.

Other objectives, advantages and novel features of the invention will become more apparent from the following detailed description when taken in conjunction with the accompanying drawings.

DETAILED DESCRIPTION OF PREFERRED EMBODIMENT

Figure 1:
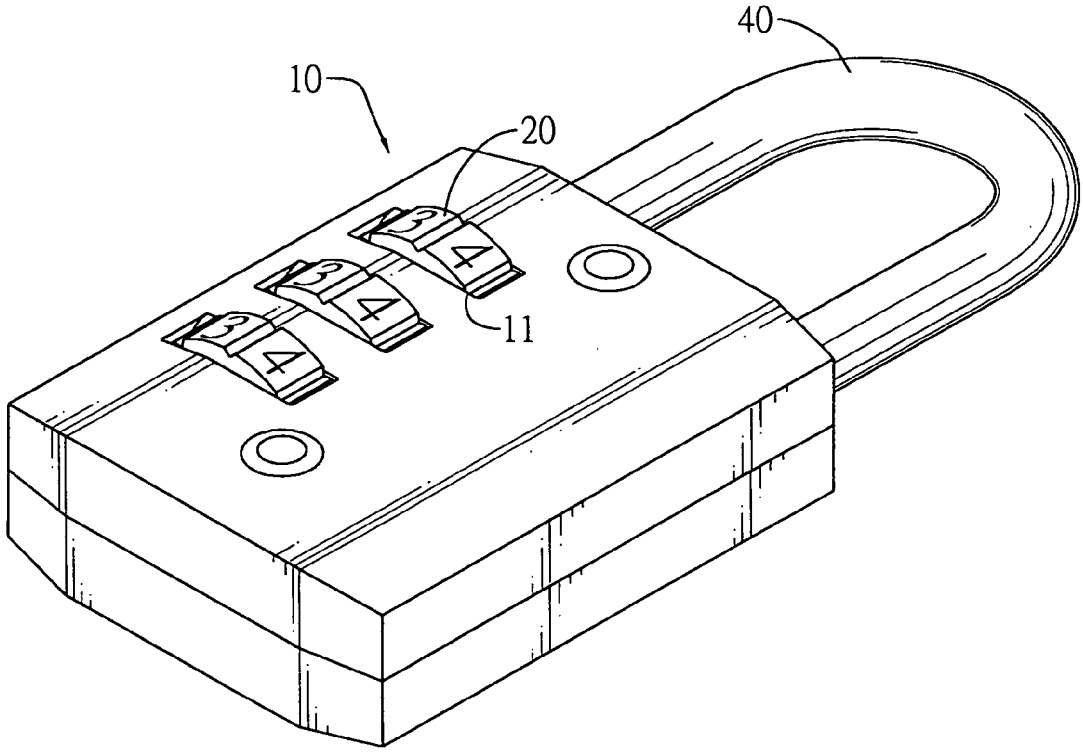
FIG. 1 is a perspective view of an error-proofing combination padlock in accordance with the present invention.
Figure 2:
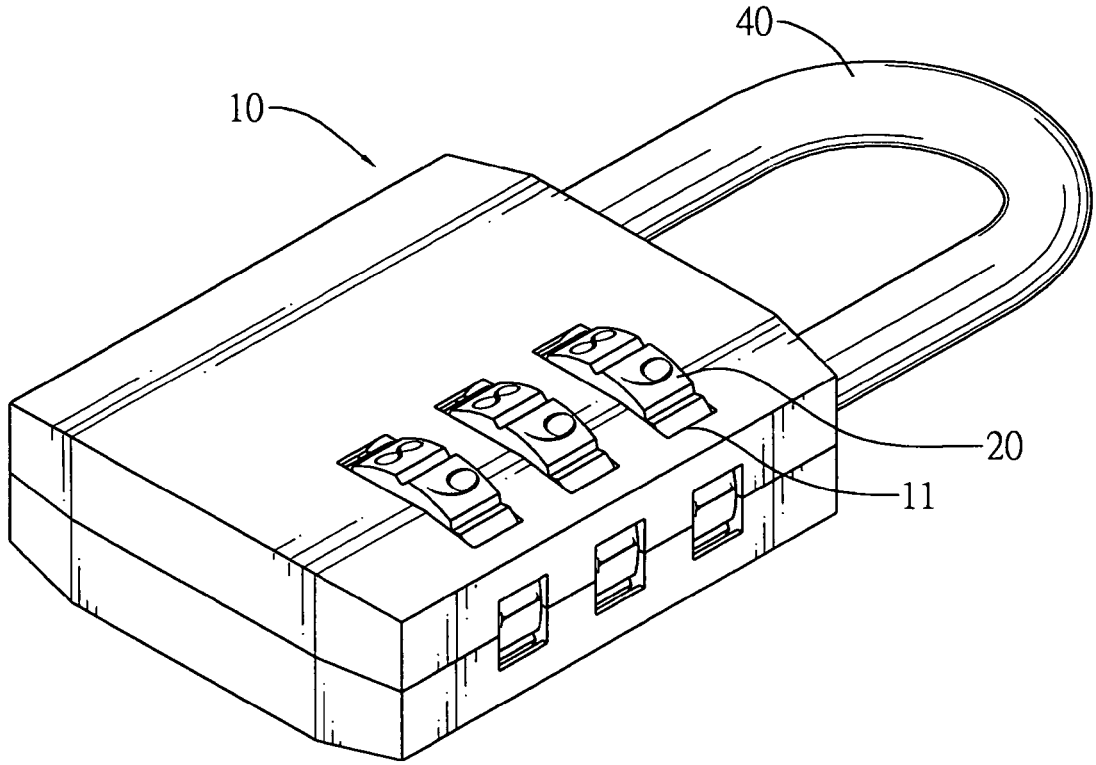
FIG. 2 is a reverse perspective view of the error-proofing combination padlock in FIG. 1.
Figure 3:
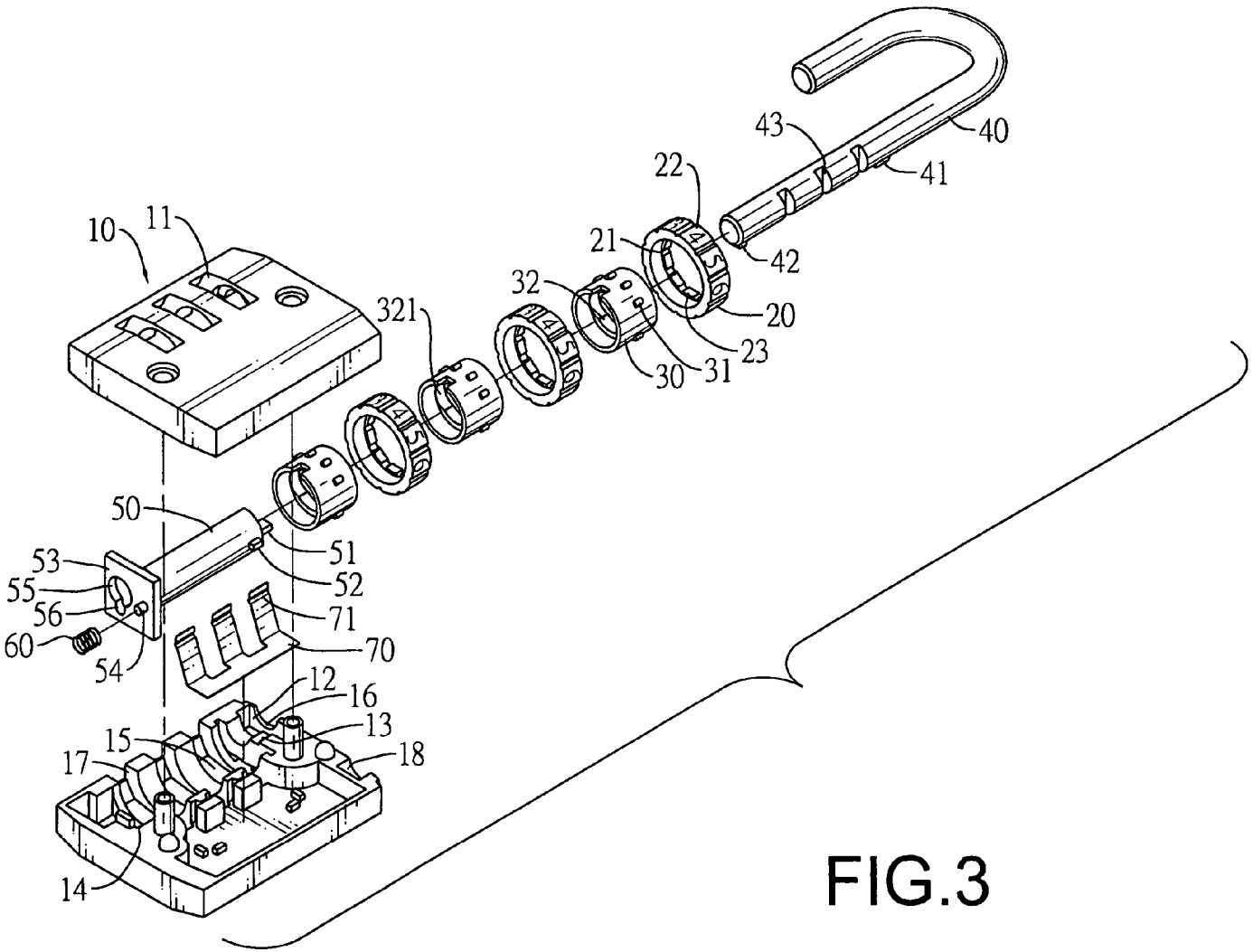
FIG. 3 is an exploded perspective view of the error-proofing combination padlock in FIG. 1.

With reference to FIGS. 1, 2 and 3, an error-proofing combination padlock in accordance with the present invention comprises a casing assembly (10), multiple dials (20), multiple sleeves (30), a shackle (40), a locking bolt (50), a spring (60) and an optional flexible tab (70).

With reference FIG. 3, the casing assembly (10) has a top casing half, a bottom casing half, a top, a bottom, a front, a back, two sides, an inner chamber, an inner surface, multiple transverse slots (11), a through hole (16), a locking socket (18), a cavity (12), a notch (13), multiple transverse inner flanges (17), multiple transverse circular recesses (15) and a mounting recess (14).

The bottom casing half is mounted on the top casing half to define the inner chamber inside the casing assembly (10). The transverse slots (11) are defined respectively through the top and bottom casing halves and arranged longitudinally at intervals. The through hole (16) is defined through the back of the casing assembly (10) and near one of the sides, and is defined by the combination of the top and bottom casing halves. The locking socket (18) is defined in the back of the casing assembly (10) and near the other side, such that it is opposite the through hole (16) and is defined by the combination of the top and bottom casing halves. The cavity (12) is defined on the inner surface in the bottom casing half close to the back of the casing assembly (10). The notch (13) is defined on the inner surface in the bottom casing half near the cavity (12). The transverse inner flanges (17) are formed on the inner surface ahead the notch (13), and are defined by the combination of the top and bottom casing halves and arranged longitudinally at intervals. The transverse circular recesses (15) are defined in the inner surface of the assembly casing (10), are defined by the combination of the top and bottom casing halves, and arranged longitudinally at intervals, wherein adjacent transverse circular recesses (15) are separated by the respective transverse inner flange (17). The mounting recess (14) is defined in the inner surface in the bottom casing half and near the front of the casing assembly (10).

Figure 5:
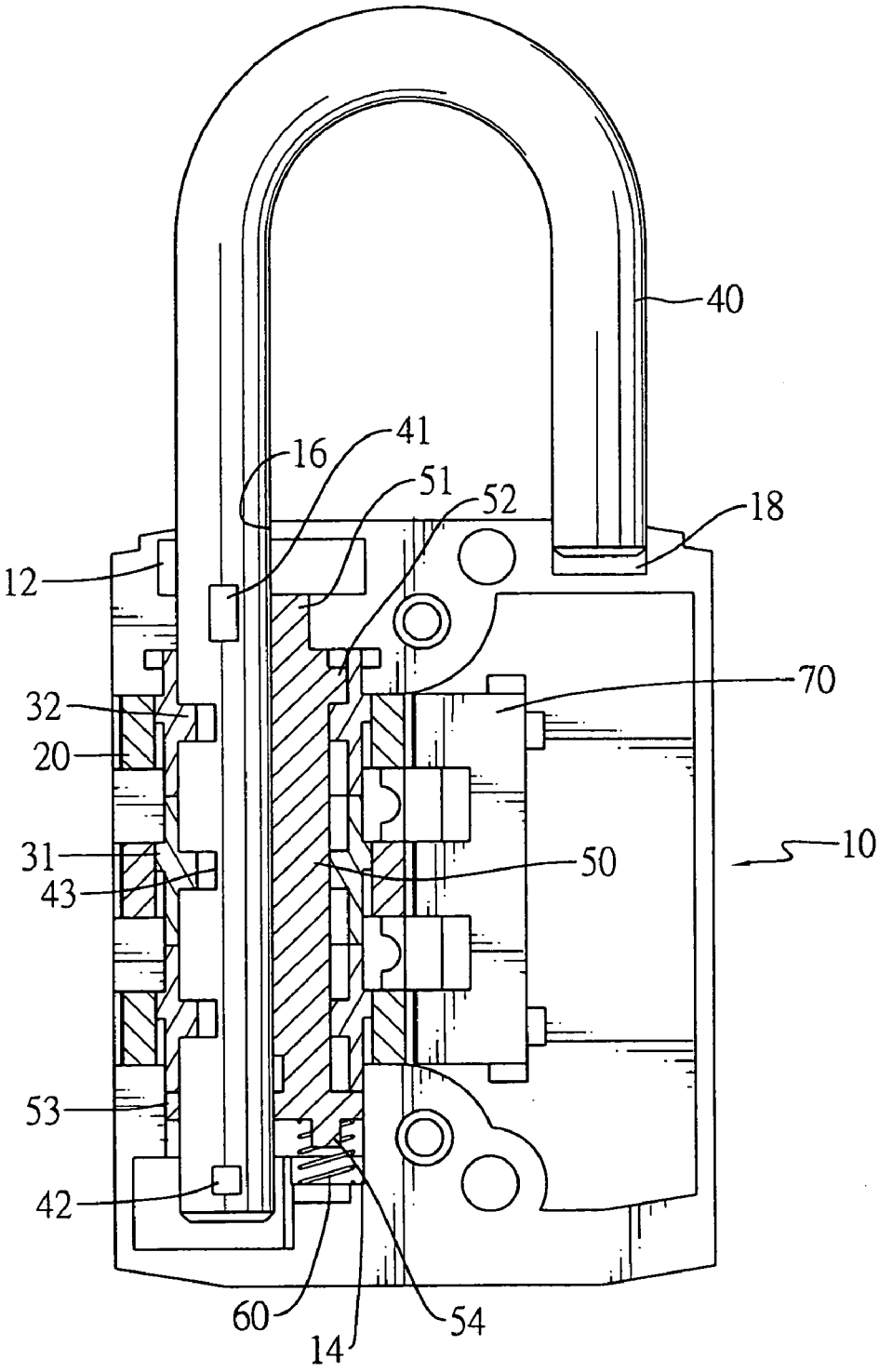
FIG. 5 is a top view in partial section of the error-proofing combination padlock in FIG. 1 showing that the shackle is in the locking (first) position.

With reference FIGS. 3 and 5, the dials (20) are mounted rotatably and respectively in the transverse circular recesses (15) and extend respectively through the transverse slots (11). Each dial (20) has an inner surface, an outer surface, multiple inner keys (23), multiple keyways (21), multiple numerals (22) and multiple optional indents. The inner keys (23) are formed on the inner surface of the dial (20) and are arranged at intervals. The keyways (21) are defined respectively between the adjacent inner keys (23). The numerals (22) such as 0, 1, 2, 3, etc. are formed on the outer surface of the dial (20) and correspond to the keyways (21). The optional indents are defined in the outer surface respectively between the adjacent numerals (22).

With reference FIGS. 3 and 5, the sleeves (30) correspond to the dials (20), are mounted rotatably and respectively inside the dials (20) and arranged longitudinally adjacent to each other. Each sleeve (30) has a front end, a back end, an outer surface, an inner surface, multiple outer keys (31) and an inner flange (32). The outer keys (31) are formed on the outer surface of the sleeve (30) and correspond to the keyways (21) of the dial (20). The inner flange (32) is formed on the inner surface of the sleeve (30) and has a front, a back and a gap (321) defined in the inner flange (32).

Figure 4:
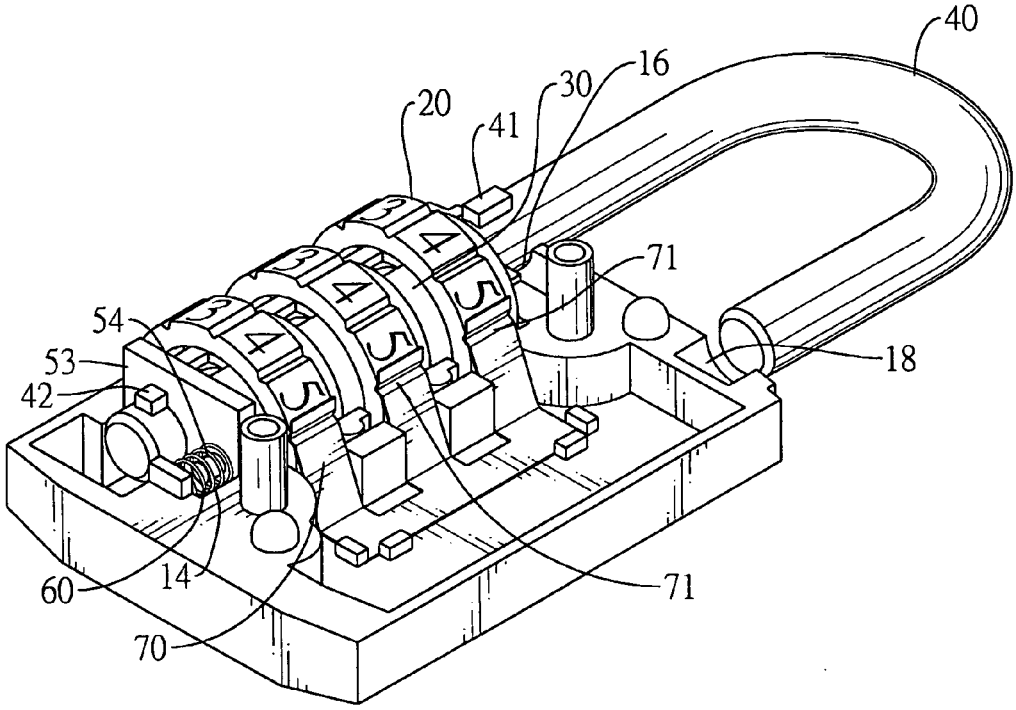
FIG. 4 is a perspective view of the error-proofing combination padlock in FIG. 1 without the top casing member.

With reference FIGS. 3, 4 and 5, the shackle (40) is mounted retractably and pivotally on the casing and has a circular cross-section, a longitudinal shaft section, a hook section, multiple transverse sockets (43), a push block (41) and a shackle-retaining block (42). The longitudinal shaft section is mounted slidably and rotatably through the sleeves (30), extends through the through hole (16) on the back of the casing assembly (10), corresponds to the gaps (321) respectively of the inner flanges (32) and has a front end and back end. The hook section is formed on the back end of the longitudinal shaft section and has a locking end corresponding to the locking socket (18). The transverse sockets (43) are defined on the longitudinal shaft section and correspond to the inner flanges (32) respectively of the sleeves (30). The push block (41) is formed on the longitudinal shaft section and close to the back end. The shackle-retaining block (42) is formed on the longitudinal shaft section close to the front end and aligned with the push block (41).

With reference FIGS. 3 and 5, the locking bolt (50) is mounted slidably through the sleeves (30) inside the casing assembly (10) and has an inner curved surface, an outer curved surface, a front end, a back end, a longitudinal protrusion (51), a transverse protrusion (52), a front board (53), an optional mounting cylinder (54), a through hole (55) and a notch (56). The longitudinal protrusion is formed on the back end of the locking bolt (50). The transverse protrusion (52) is formed on the outer curved surface close to the back end of the locking bolt (50) and abuts against surface of the inner flange (32) of the sleeve (30) closest to the back of the casing assembly (10). The front board (53) is formed on the front end of the locking bolt (50) and has a front surface and a back surface abutting against the front end of the sleeve (30) closest to the front of the casing assembly (10). The optional mounting cylinder (54) is formed on the front surface of the front board (53). The through hole (55) is defined through the front board (53) and near the inner curved surface to correspond to the longitudinal shaft section of the shackle (40). The notch (56) is defined through the front board (53) and below the through hole (55) to communicate with the front hole (55) and correspond to the shackle-retaining block (42).

With reference FIG. 4, the spring (60) is mounted around the optional mounting cylinder (54) and a first end thereof urges against the front surface of the front board (53) inside the mounting recess (14) in the bottom casing half.

With reference FIG. 3, the optional flexible tab (70) is mounted on the inner surface in the bottom casing half of the casing assembly (10) and has multiple legs. The legs correspond to and respectively press against the dials (20). Each leg has a distal end and a talon (71) formed on the distal end and corresponding to the optional indent of the dials (20).

With reference FIG. 5, the shackle (40) is in a locking (first) position. The locking end of the hook section of the shackle (40) engages into the locking socket (18). The inner flanges (32) respectively extend through transverse sockets (43) to prevent the shackle (40) from moving.

Figure 6:
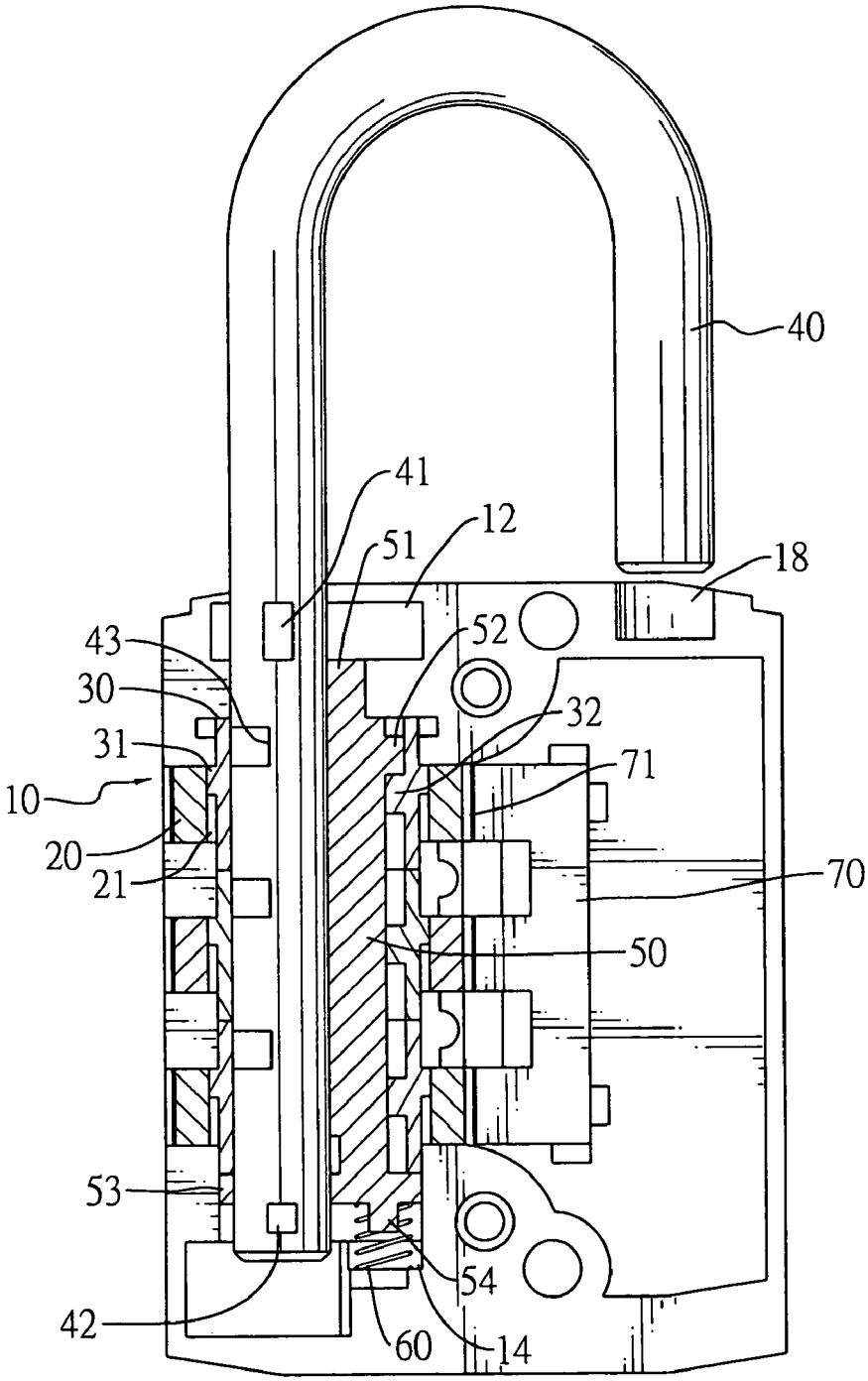
FIG. 6 is a top view in partial section of the error-proofing combination padlock in FIG. 1 showing that the shackle is in the unlocking (second) position.

With reference FIG. 6, the shackle (40) is in an unlocking (second) position. The dials (20) are rotated according to an unlocking combination and respectively drive the sleeves (30) to rotate with the engagement of the keyways (21) and the outer keys (31). The gaps (321) in the sleeves (30) are rotated to respectively face the transverse sockets (43) and thereby allow the moving of the shackle (40). The shackle (40) slides backward to leave the locking end extending out of the locking socket (18).

Figure 7:
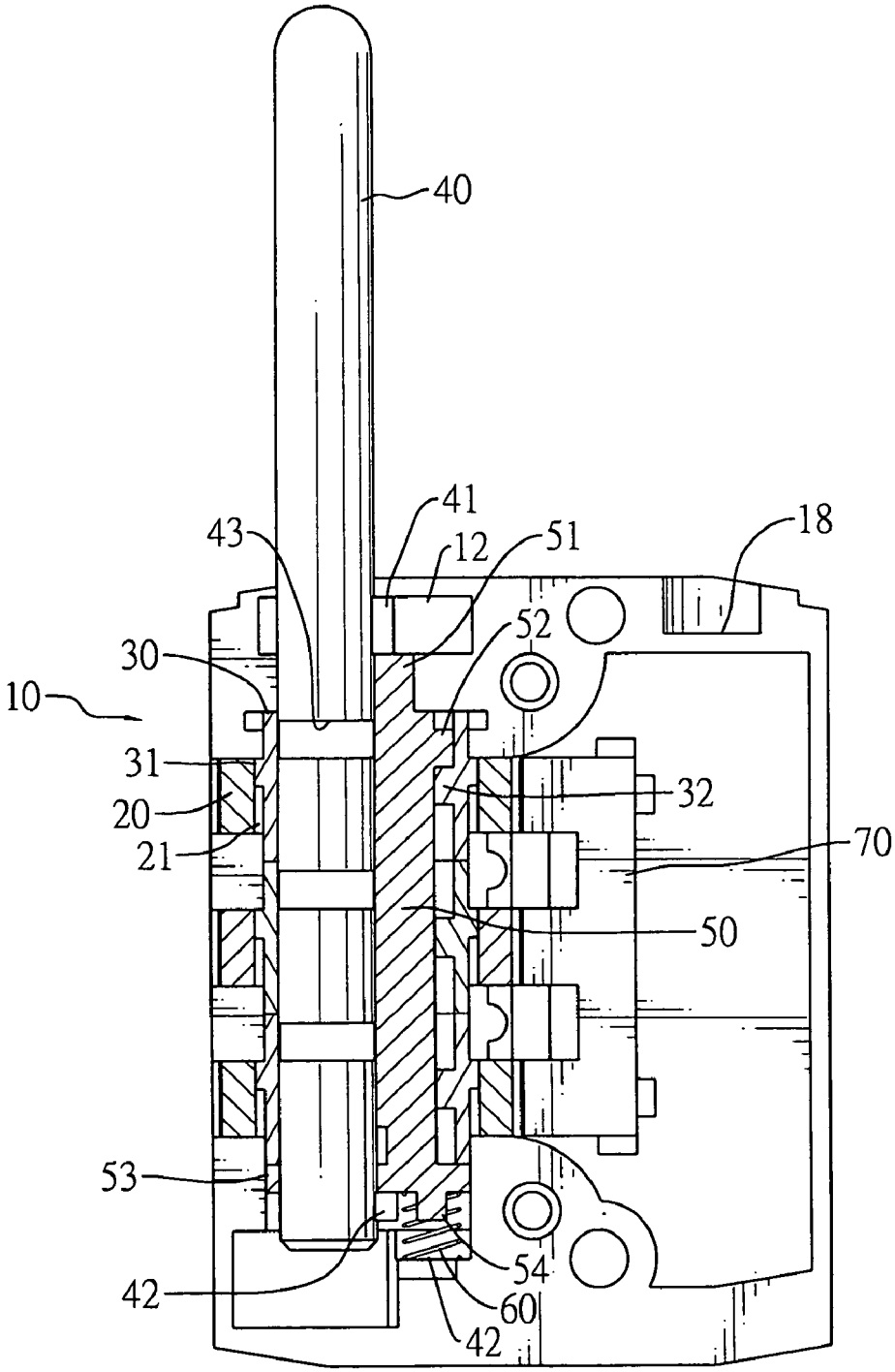
FIG. 7 is a top view in partial section of the error-proofing combination padlock in FIG. 1 showing that the shackle pivots clockwise for 90 degrees relative to the unlocking position to make the push block abut against the longitudinal protrusion of the lock bolt.
Figure 8:
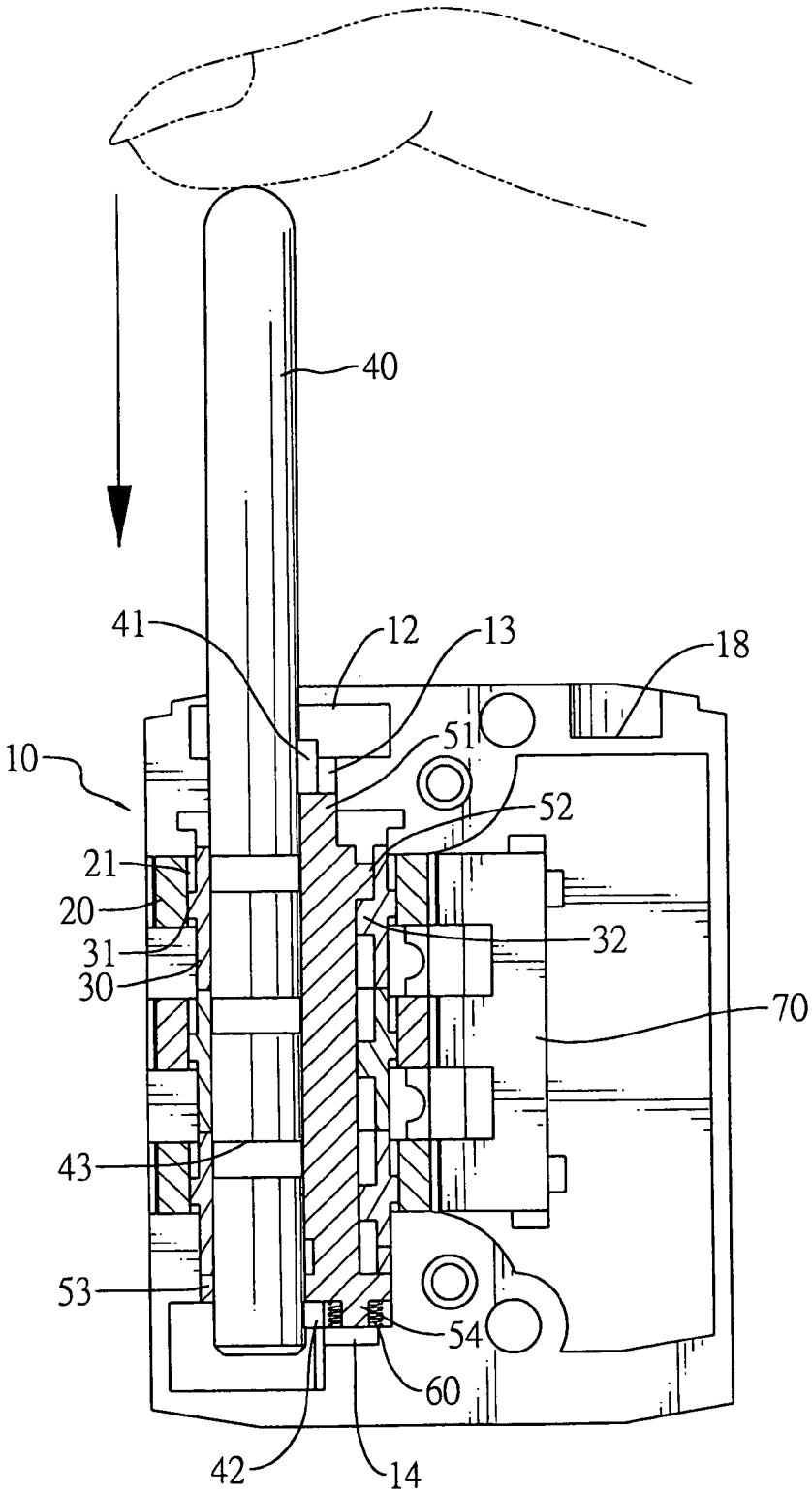
FIG. 8 is an operational view in partial section of the error-proofing combination padlock in FIG. 1 showing that the shackle is pushed into the resetting position with an external force.

With reference FIGS. 7 and 8, the shackle is rotated clockwise 90 degrees relative to the unlocking position and then depressed with an external force such as from a finger to get into a combination-resetting (third) position. The push block (41) of the shackle (41) presses against the longitudinal protrusion (51) of the locking bolt (50) and causes the locking bolt (50) to move forward. The transverse protrusion (52) of the locking bolt (50) presses against the back of the inner flange (32) of the sleeve (30) closest to the back of the casing assembly (10) and causes all of the sleeves (30) to move forward to compress the spring (60). The outer keys (31) are disengaged with the corresponding keyways (21) of each dial (20), and thereby the dials (20) are rotated without sleeves (30) to allow the unlocking combination to be reset. The shackle (41) automatically return to the unlocking (second) position because a resilience of the spring (60) once the external force is released.

Figure 9:
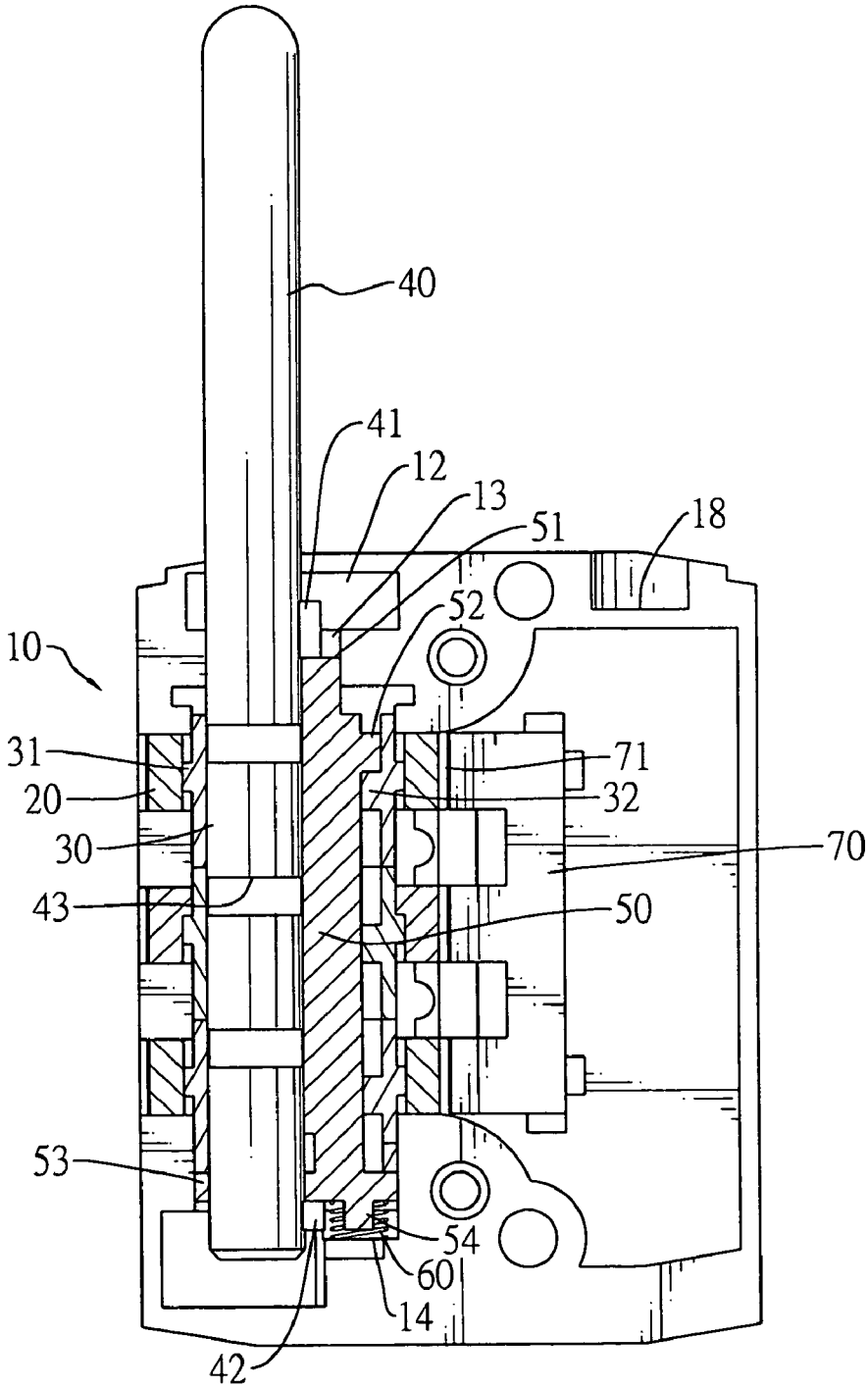
FIG. 9 is a top view in partial section of the error-proofing combination padlock in FIG. 1 showing that one (plurality) of the dials is (are) in a wrong position and the inner keys of the dial(s) lock the outer keys of the sleeve to prevent the sleeve and the shackle from moving back to the unlocking second position when the external force is removed.

With reference FIG. 9, if any one of the dials (20) is rotated into an incorrect position to arrive at a new combination number, the keyways (21) of the dial (20) will misalign with the outer keys (31) of the corresponding sleeve (30) and the inner keys (23) of the dial (20) will block the outer keys (31). When the external force pressing on the shackle (40) is removed, all of the sleeves (30) and the locking bolt (50) are still blocked by the dial (20) and unable to move backward with the resilience of the spring (60). The shackle-retaining block (42) is blocked by the front board (53) so that the shackle (40) is unable to move backward to the unlocking (second) position. The now immovable shackle (40) reminds a user that combination resetting process is not successful and the user needs to confirm all the locations of the dials (20) for completion of the new unlocking combination.

The error-proofing combination padlock in accordance with the present invention prevents dials (20) from rotating unless the shackle (40) is located in the locking (first) position or the combination-resetting position and avoids a new incorrect unlocking combination occurring during a resetting operation of the unlocking combination. Therefore, the error-proofing combination padlock in accordance with the present invention prevents errors caused by carelessness from occurring and is easy to use.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An error-proofing combination padlock comprising:

a casing assembly having a top casing half;

a bottom casing half mounted on the top casing half;

a top;

a bottom;

a front;

a back;

two sides;

an inner chamber;

an inner surface;

multiple transverse slots defined respectively through the top and bottom casing halves and arranged longitudinally at intervals;

a through hole defined through the back of the casing assembly and near one of the sides of the casing assembly;

a locking socket defined in the back of the casing assembly and near the other side of the casing assembly, to be opposite the through hole;

a cavity defined in the bottom casing half; a notch defined in the bottom casing half;

multiple transverse inner flanges formed on the inner surface and arranged longitudinally at intervals;

multiple transverse circular recesses defined in the inner surface and arranged longitudinally at intervals, wherein adjacent transverse circular recesses are separated by the transverse inner flange; and a mounting recess defined in the bottom casing;

multiple dials rotatably and respectively mounted in the transverse circular recesses and extending respectively through the transverse slots and each having an inner surface;

an outer surface;

multiple inner keys formed on the inner surface of each dial and arranged at intervals;

multiple keyways defined respectively between adjacent inner keys; and multiple numerals formed on the outer surface of each dial and corresponding to the keyways;

multiple sleeves correspond to the dials, mounted rotatably and respectively inside the dials and arranged longitudinally adjacent to each other and each having a front end;

a back end;

an outer surface;

an inner surface;

multiple outer keys formed on the outer surface of each sleeve, and corresponding to the keyways of the dial; and an inner flange formed on the inner surface of the sleeve and having a front, a back and a gap defined on the inner flange;

a shackle mounted retractably and pivotally on the casing and having a circular cross-section;

a longitudinal shaft section mounted slidably and rotatably through the sleeves, extending through the through hole in the casing assembly, corresponding to the gaps respectively of the inner flanges and having a front end and back end;

a hook section formed on the back end of the longitudinal shaft section and having a locking end corresponding to the locking socket;

multiple transverse sockets defined on the longitudinal shaft section and corresponding to the inner flanges respectively of the sleeves;

a push block formed on the longitudinal shaft section and close to the back end of the longitudinal shaft section; and a shackle-retaining block formed on the longitudinal shaft section close to the front end and aligned with the push block;

a locking bolt mounted slidably through the sleeves inside the casing assembly and having an inner curved surface;

an outer curved surface;

a front end;

a back end;

a longitudinal protrusion formed on the back end of the locking bolt;

a transverse protrusion formed on the outer curved surface close to the back end of the locking bolt and abutting against a surface of the inner flange of the sleeve closest to the back of the casing assembly;

a front board formed on the front end of the locking bolt and having a front surface and a back surface abutting against the front end of the sleeve closest to the front of the casing assembly;

a through hole defined through the front board and near the inner curved surface and corresponding to the longitudinal shaft section of the shackle; and a notch defined through the front board and under the through hole, communicated with the front hole and corresponding to the shackle-retaining block; and a spring mounted against the surface of the front board inside the mounting recess in the bottom casing half.

2. The error-proofing combination padlock as claimed in claim 1, wherein each dial has multiple indents defined in the outer surface of the dial and respectively between adjacent numerals.

3. The error-proofing combination padlock as claimed in claim 2 further comprising a flexible tab mounted on the inner surface in the bottom casing half of the casing assembly and having multiple legs corresponding to and respectively pressing against the dials and each leg having a talon formed on the distal end and corresponding to one of the indents of a corresponding one of the dials.

4. The error-proofing combination padlock as claimed in claim 3, wherein the locking bolt further comprises a mounting cylinder formed on the front surface of the front board and extending into the spring.

* * * * *